US010165660B2

(12) United States Patent
Wilkolaski

(10) Patent No.: US 10,165,660 B2
(45) Date of Patent: Dec. 25, 2018

(54) LOW-VOLTAGE CONTROLLER WITH DIMMING FUNCTION AND METHOD

(71) Applicant: Curbell Medical Products, Inc., Orchard Park, NY (US)

(72) Inventor: Edward Wilkolaski, South Wales, NY (US)

(73) Assignee: Curbell Medical Products, Inc., Orchard Park, NY (US)

( * ) Notice: Subject to any disclaimer, the term of this patent is extended or adjusted under 35 U.S.C. 154(b) by 0 days.

(21) Appl. No.: 15/997,735

(22) Filed: Jun. 5, 2018

(65) Prior Publication Data

US 2018/0288861 A1 Oct. 4, 2018

Related U.S. Application Data

(62) Division of application No. 14/509,017, filed on Oct. 7, 2014, now Pat. No. 10,015,867.

(51) Int. Cl.
*H05B 37/02* (2006.01)

(52) U.S. Cl.
CPC ..... *H05B 37/0272* (2013.01); *H05B 37/02* (2013.01)

(58) Field of Classification Search
CPC ..... Y02B 20/46; H05B 37/02; H05B 37/0272
USPC ..... 315/157, 293, 307; 5/905
See application file for complete search history.

(56) References Cited

U.S. PATENT DOCUMENTS

| | | | | |
|---|---|---|---|---|
| 5,544,376 | A | 8/1996 | Fromson | |
| 5,909,087 | A * | 6/1999 | Bryde | H05B 37/0263 315/149 |
| 6,175,201 | B1 | 1/2001 | Sid | |
| 8,432,287 | B2 | 4/2013 | O'Keefe | |
| 9,361,769 | B2 | 6/2016 | Traughber | |
| 9,525,374 | B2 | 12/2016 | Inoue | |
| 2005/0146288 | A1 * | 7/2005 | Johnson | H05B 39/083 315/291 |
| 2006/0220460 | A1 | 10/2006 | Grolmes | |
| 2009/0195168 | A1 | 8/2009 | Greenfeld | |
| 2011/0109249 | A1 | 5/2011 | Liu et al. | |
| 2011/0291585 | A1 | 12/2011 | Foo | |

FOREIGN PATENT DOCUMENTS

| | | |
|---|---|---|
| CN | 103313483 | 9/2013 |

* cited by examiner

*Primary Examiner* — Thuy Vinh Tran
(74) *Attorney, Agent, or Firm* — Hodgson Russ LLP

(57) ABSTRACT

A low-voltage controller (LVC) is configured to utilize a low-voltage signal to operate a high-voltage load, such as, for example, a lamp. The LVC is configured to receive a low-voltage step signal at a switch input. The LVC has a line input for connection to a source of power at a line voltage and a load output for connection to a load, and a dimmer for setting an intensity of the load. Subsequent step signals alter the intensity of the load. A method for low-voltage control of a lamp is provided. A method includes the steps of receiving a first switch signal at a switch input of an LVC; setting the lamp to a first intensity; receiving a second switch signal at the switch input; and setting the lamp to a second intensity.

7 Claims, 10 Drawing Sheets

LOW-VOLTAGE CONTROLLER WITH DIMMING FUNCTION AND METHOD

CROSS-REFERENCE TO RELATED APPLICATIONS

This application is a Divisional application of U.S. patent application Ser. No. 14/509,017, filed on Oct. 7, 2014, which is now U.S. patent Ser. No. 10/015,867, the disclosure of which is incorporated herein by reference.

FIELD OF THE DISCLOSURE

The present disclosure relates to load controllers suitable for hospital use.

BACKGROUND OF THE DISCLOSURE

Patient control of hospital systems is generally accomplished through the use bed-side controls, such as, for example, bed-side pendants, connected to in-room equipment and a nurse call station. Such pendants allow a patient to page a nurse, control a television, and/or turn lights and other loads within the patient vicinity, on and off. Due to the nature of the hospital environment, such pendants must be safe for use by patients despite the close proximity to liquids, flammable gases, and physical abuse (e.g., drops on to the floor). To ensure the safety of patients and hospital staff, bed-side devices utilize low voltages to control devices which may operate at high voltages.

Low-voltage controllers (LVCs) are provided to facilitate low-voltage control of high-voltage loads, such as, for example, lamps and motorized curtains. Often, LVCs utilize a low-voltage signal from a momentary switch to signal a load to turn on or off and the switch signal may be simultaneously provided to the nurse call station where additional actions may occur. However, while current LVCs provide patients with the ability to turn lamps on or off, there exists no LVCs which offer the ability to dim lamps to one or more intermediate levels. As such, there is a need for an LVC that allows for integration into existing hospital systems, and that can provide the ability to select an appropriate light level.

SUMMARY OF THE DISCLOSURE

A low-voltage controller (LVC) is configured to utilize a low-voltage signal to operate a high-voltage load, such as, for example, a lamp. The LVC is configured to receive a low-voltage step signal at a switch input, such as, for example, from a momentary switch of a a pillow speaker. The LVC has a line input for connection to a source of power at a line voltage and a load output for connection to a first load (e.g., providing power to the first load). The LVC comprises a dimmer configured to set an intensity of the first load, for example, based on a step signal received at the switch input of the LVC. The LVC can be configured such that subsequent step signals received at the switch input will alter the intensity of the load.

In some embodiments, the LVC includes a second switch input and a second load output for providing power to a second load. Embodiments of the disclosed LVC may comprise additional switch inputs and/or load outputs for driving a number of loads. Additional switch inputs and outputs may be configured to drive the load with a non-dimming signal (e.g., on/off) or dimming signal with any number of intensity levels.

The present disclosure may be an LVC, such as that described above, used as part of a load-control system having a patient interface (for example, a pillow speaker) connected to a nurse call station. The patient interface includes a switch. For example, many pillow speakers include a momentary-contact switch for turning a light on or off. The LVC may be configured to receive a step signal from the switch of the patient interface (for example, by way of the nurse call station) to cause the load to vary in intensity. Such a configuration advantageously allows the presently disclosed dimming LVC to be operated by present hospital room equipment, and to provide new functionality such as dimming hospital room lights.

A method for low-voltage control of a load is provided. The method comprises the step of receiving a first switch signal at a switch input of an LVC; setting a lamp to a first intensity; receiving a second switch signal at the switch input of the LVC; and setting the lamp to a second intensity which is different than the first intensity. The method comprises the step of receiving a third switch signal at the switch input of the LVC, whereby the lamp is turned off. Additional steps may be included where more levels of intensity are desired.

DESCRIPTION OF THE DRAWINGS

For a fuller understanding of the nature and objects of the disclosure, reference should be made to the following detailed description taken in conjunction with the accompanying drawings, in which.

DETAILED DESCRIPTION OF THE DISCLOSURE

Figure 1:
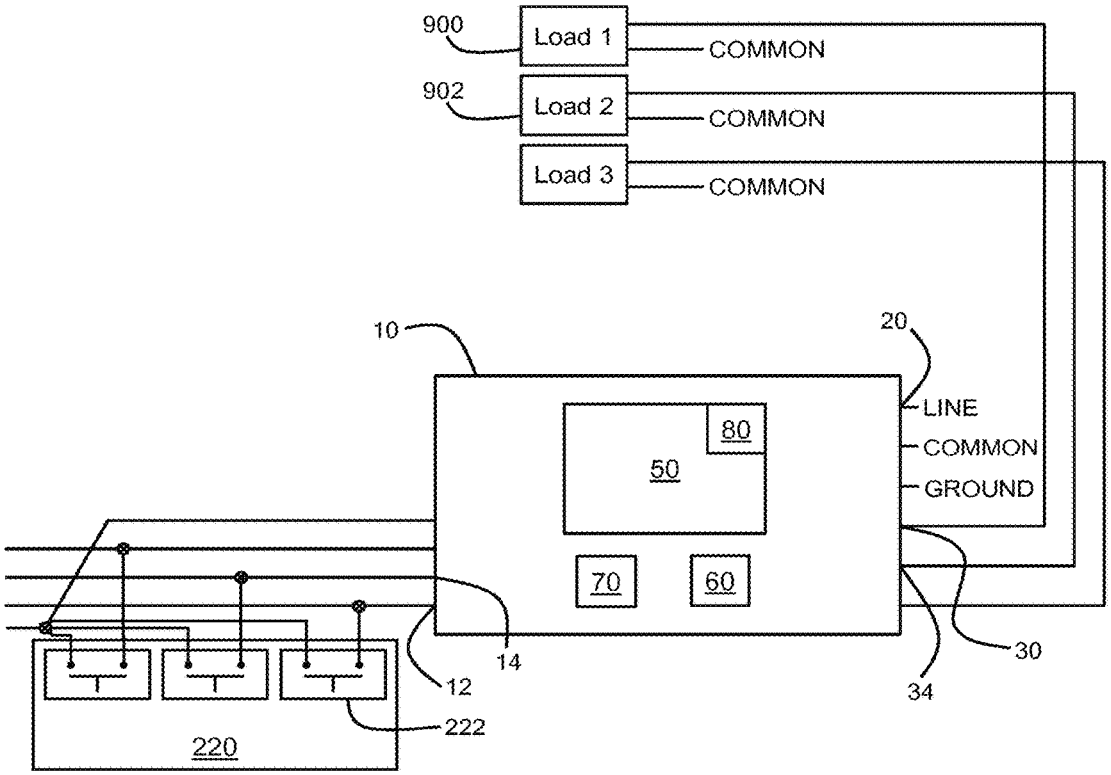
FIG. 1 is a diagram of a system having a low-voltage controller according to an embodiment of the present disclosure.

With reference to FIG. 1, the present disclosure can be embodied as a low-voltage controller (LVC) 10. The LVC 10 may be configured to utilize a low-voltage signal to operate a high-voltage load, such as, for example, a lamp. As used herein, "low voltage" refers to a direct current (DC) signal having an operating voltage below a level that is injurious to a person, in some embodiments low voltage is less than 50 VDC, in some embodiments low voltage is less than 10 VDC, in some embodiments low voltage may be a negative voltage, for example, less than −50 VDC (i.e., in the range of −50-0 VDC), −10 VDC (i.e., −10-0 VDC), etc. As used herein, "high voltage" refers to a voltage sufficient to power a load such as a lamp, and is often an alternating current (AC) signal. In some embodiments high voltage is greater than 100 VAC, in some embodiments high voltage can range from 115-277 VAC, in some embodiments high voltage is 120 VAC, and in some embodiments, high voltage is 230 VAC.

The LVC 10 comprises a switch input 12 which is configured to receive a low-voltage step signal. As used herein, a "step signal" refers to any type of transient signal, for example, in some embodiments the step signal is a step up in voltage (i.e., rising edge), in some embodiments the step signal is a step down in voltage (i.e., falling edge), in some embodiments the step signal is an impulse signal having a step up and a step down. The switch input 12 may be configured to receive the step signal from a momentary switch 222 of a patient interface 220, for example, a pillow speaker. The patient interface may be connected directly to the switch input 12 or indirectly by way of one or more other devices, such as a nurse call station 210.

The LVC 10 comprises a line input 20 for connection to a source of power at a line voltage. For example, the line input 20 may be connected to 120 VAC directly or by way of a standard U.S. wall receptacle (e.g., NEMA 5-15R).

The LVC 10 further comprises a load output 30 that is configured to connect to a first load 900, such as a lamp. The load output 30 provides power to the first load 900. As further described below, in some embodiments the load output 30 can be selectively operated to provide power to the first load 900, while in other embodiments the load output 30 is a constant source of power to the first load 900.

The LVC 10 further comprises a dimmer 50 that is configured to set an intensity of the first load 900. The dimmer 50 may set the intensity of the first load 900 based on a step signal received at the switch input 12 of the LVC 10. For example, a first step signal may cause the dimmer 50 to set the first load 900 to a first intensity (for example, change a lamp from 0% intensity (off) to 100% intensity (fully on)). In the example, a second step signal received at the switch input 12 of the LVC 10 may cause the dimmer 50 to set the first load 900 to a second intensity (for example, dim the lamp from 100% intensity to 50% intensity). In the example, a third step signal received at the switch input 12 may cause the dimmer 50 to set the first load 900 to a third intensity (for example, turn the lamp off). It should be noted that the present disclosure may be used to set a load to any of number of intensity levels from three levels (on, dim, off) to any number limited only by practical considerations of a particular application. Furthermore, the levels need not be evenly distributed throughout the intensity range of the load (e.g., 0%, 25%, 50%, 100% intensity) nor does the intensity range necessarily extend to 100% of the rated capacity of a load (for example, the maximum intensity may be limited to something less than the load rating—e.g., 80% of the rating).

The LVC 10 may comprise an electronic switch to provide power to the first load 900. In some embodiments, the LVC 10 comprises a relay 60 for providing power to the first load 900. The power provided to the first load 900 by way of the relay 60 can be configured to drive the first load 900 with a selected intensity level. In some embodiments, the relay coil 60 may be energized by the PWM signal in order to reduce the power dissipated by the relay 60. In other embodiments, the LVC 10 may comprise a PWM generator 70 for generating a PWM signal having a selectively variable duty cycle. A PWM signal may be used to drive the first load 900 with an intensity based on a duty cycle of the PWM signal. The dimmer 50 may be used to select the duty cycle of the PWM signal to alter the intensity of the first load 900. Other techniques for driving a load with different intensities will be apparent to one having skill in the art in light of this disclosure.

In an exemplary embodiment, the LVC 10 may comprise a programmable microcontroller 80. The microcontroller 80 is programmed to increment a switch counter when a step signal is received at the switch input 12. The switch counter has a maximum value set according to the desired number of intensity steps such that if a step signal is received at the switch input when the switch counter is at a maximum value, the switch counter will reset to an initial value. In this way, the switch counter is configured to loop through its values. In this exemplary embodiment, the microcontroller 80 is further programmed to activate/deactivate the relay 60 and/or set a duty cycle of the PWM signal according to the value of the switch counter. For example, when the switch counter resets to its initial value (in this example, the lamp is off at the initial value), the microcontroller 80 signals the relay 60 to deactivate. When a step signal is received at the switch input 12 to increment the switch counter from its initial value, the relay 60 is activated by providing a PWM signal to the relay 60. In another embodiment, when a step signal is received at the switch 12 to increment the switch counter from its initial value, the PWM generator 70 is signaled to provide a PWM signal having a first duty cycle to the first load 900 at the load output 30.

The LVC 10 may further comprise a second switch input 14 and a second load output 34 for providing power to a second load 902. In this case, the dimmer 50 is configured to set the intensity of the second load 902 when a step signal is received at the second switch input 14. It should be noted that the LVC 10 may have further switch inputs and load outputs as appropriate for a particular application.

Figure 2:
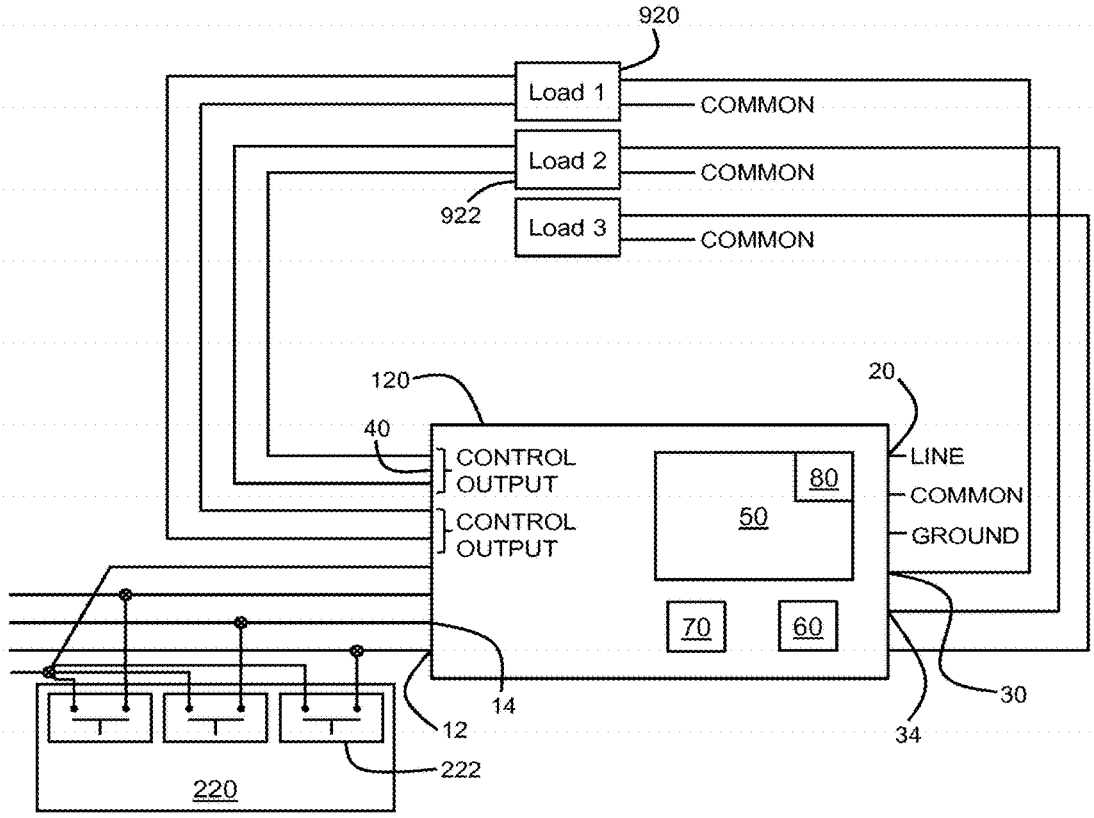
FIG. 2 is a diagram of a system having a low-voltage controller with a control output according to another embodiment of the present disclosure.

In other embodiments, the LVC 120 may further comprise a control output 40 for providing a control signal to the first load 900 (see, for example, FIG. 2). The control output 40 may be configured to be connected to the first load 900 and to provide a control signal formatted to a protocol recognized by the first load 900. For example, the first load 900 may be a 0-10 V device, and the control signal may be a 0-10 V-formatted signal provided to the first load 900 from the control output 40. The control signal may be formatted to any standard or proprietary protocol such as, for example, 0-10V, ACN, ASCII, BACnet, DALI, DMX512, EnOcean, Konnex, LonWorks, MIDI, Modbus, RDM, SMPTE®, TCP/IP, XML, Zigbee®, or Z-Wave®. In such embodiments, the load output 30 of the LVC 120 may be configured to be a constant source of power to the first load 900 or the load output 30 may be configured to provide power only when the first load 900 is not off. The LVC 120 may have additional switch inputs, load outputs, and control outputs 40 for communicating and controlling additional loads.

Figure 3:
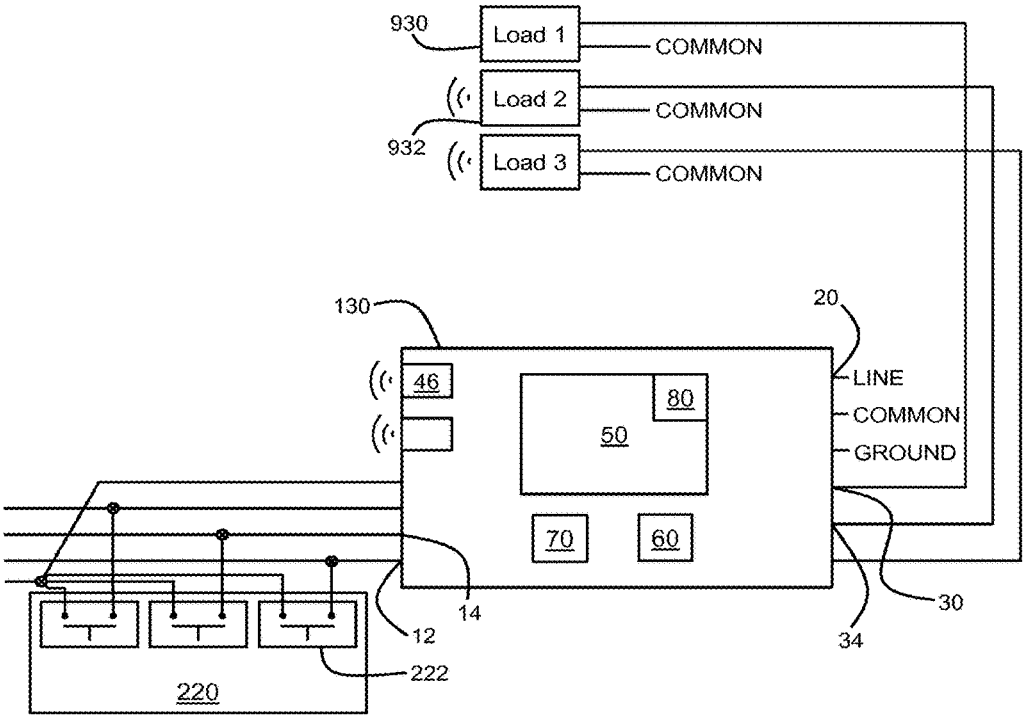
FIG. 3 is a diagram of a system having a low-voltage controller with a wireless transceiver according to another embodiment of the present disclosure.
Figure 4A:
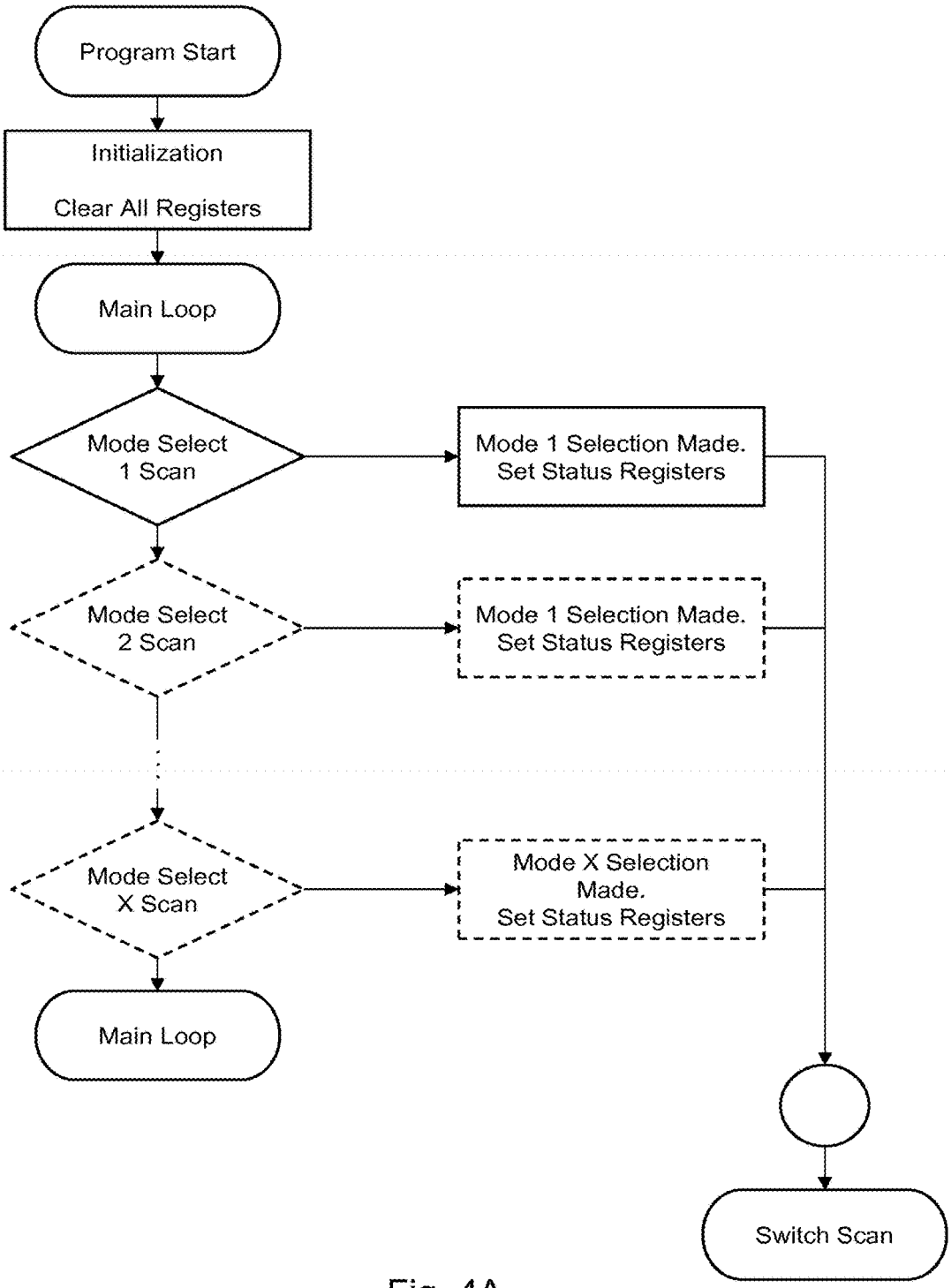
FIGS. 4A-4E are flowcharts of a microcontroller program according to an embodiment of the present disclosure.
Figure 4B:
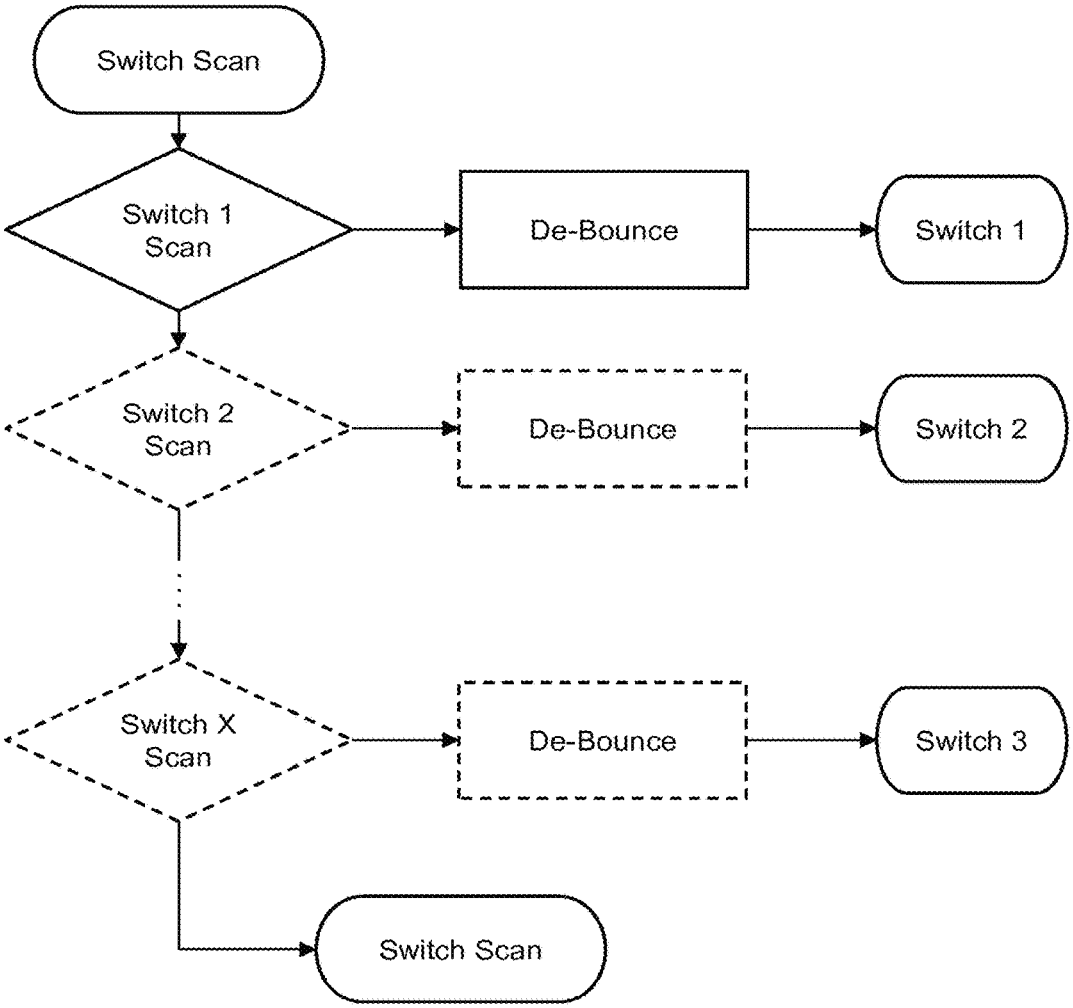
Figure 4C:
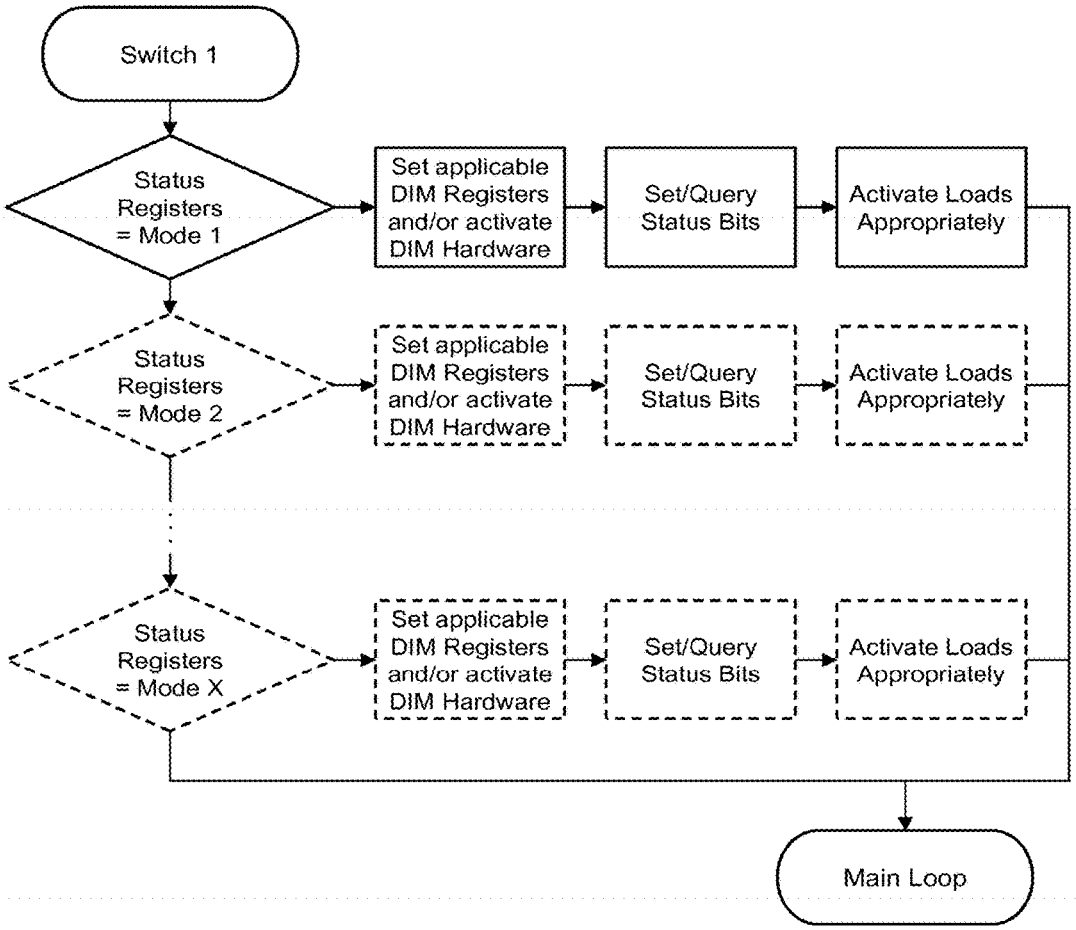
Figure 4D:
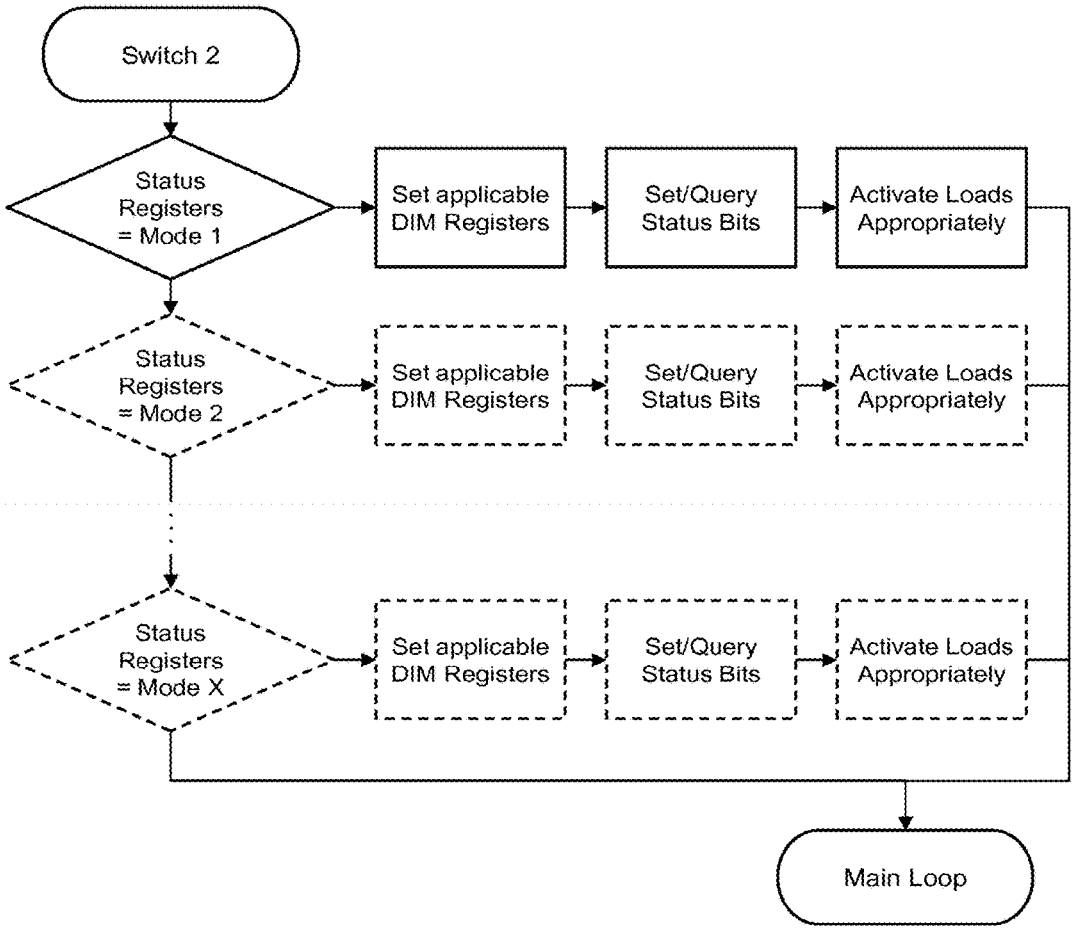
Figure 4E:
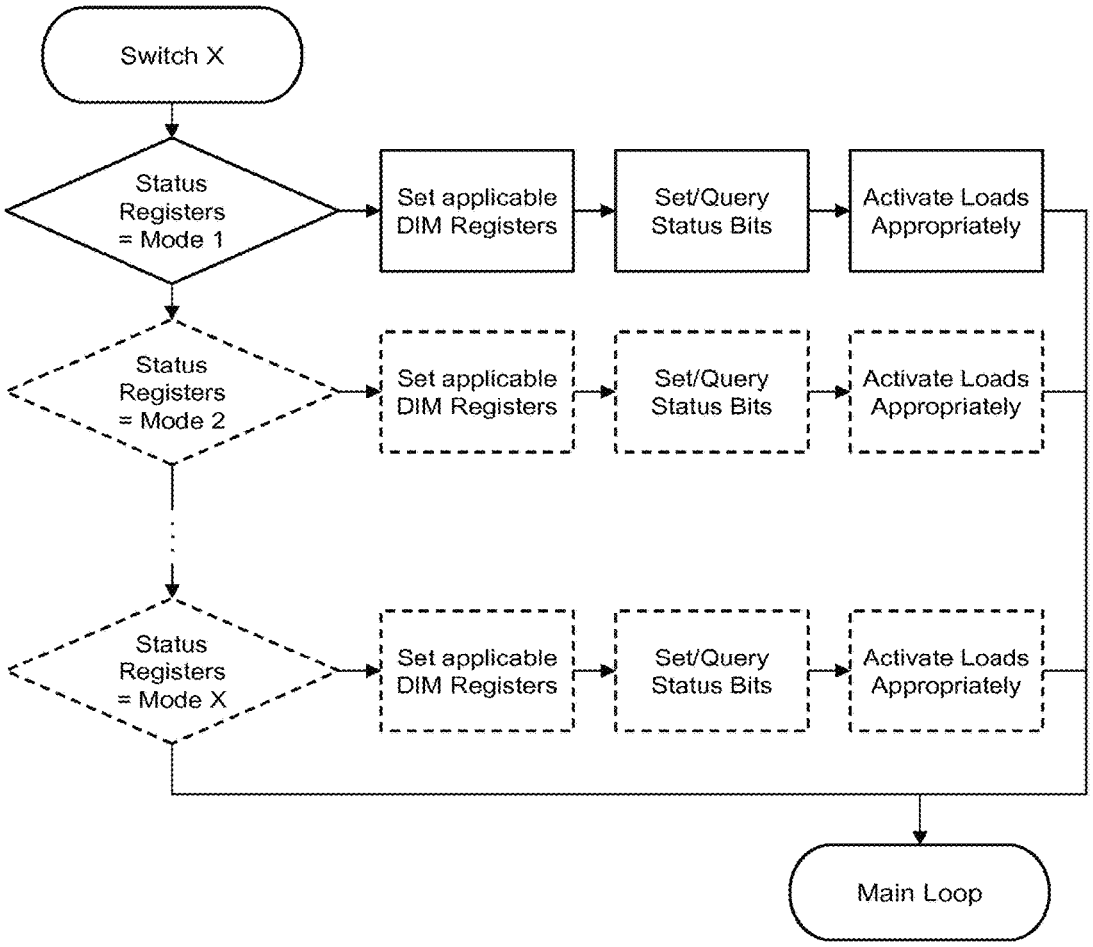

In some embodiments of the LVC 130, the control output 46 is a wireless transceiver configured to communicate with a corresponding wireless transceiver of the first load 930 (see, for example, FIG. 3). For example, where the control signal is formatted according to a wireless protocol, such as, for example, Zigbee or Z-wave, the LVC 130 and the first load 930 may each have a wireless transceiver configured to the appropriate protocol. The LVC 130 may have additional switch inputs, load outputs, and control outputs 46 (wireless transceivers) for communicating and controlling additional loads.

In embodiments having control output(s) 40, 46, a microcontroller 80 may be programmed to transmit a control signal to the load(s) in accordance with step signals received at the switch input 12. For example, the microcontroller 80 may utilize a previously-described switch counter to step through control signals that command the load to set to an intensity—e.g., send a dim 50% control signal to the load. The microcontroller 80 may be programmed to generate a control signal formatted to a particular protocol.

Figure 5:
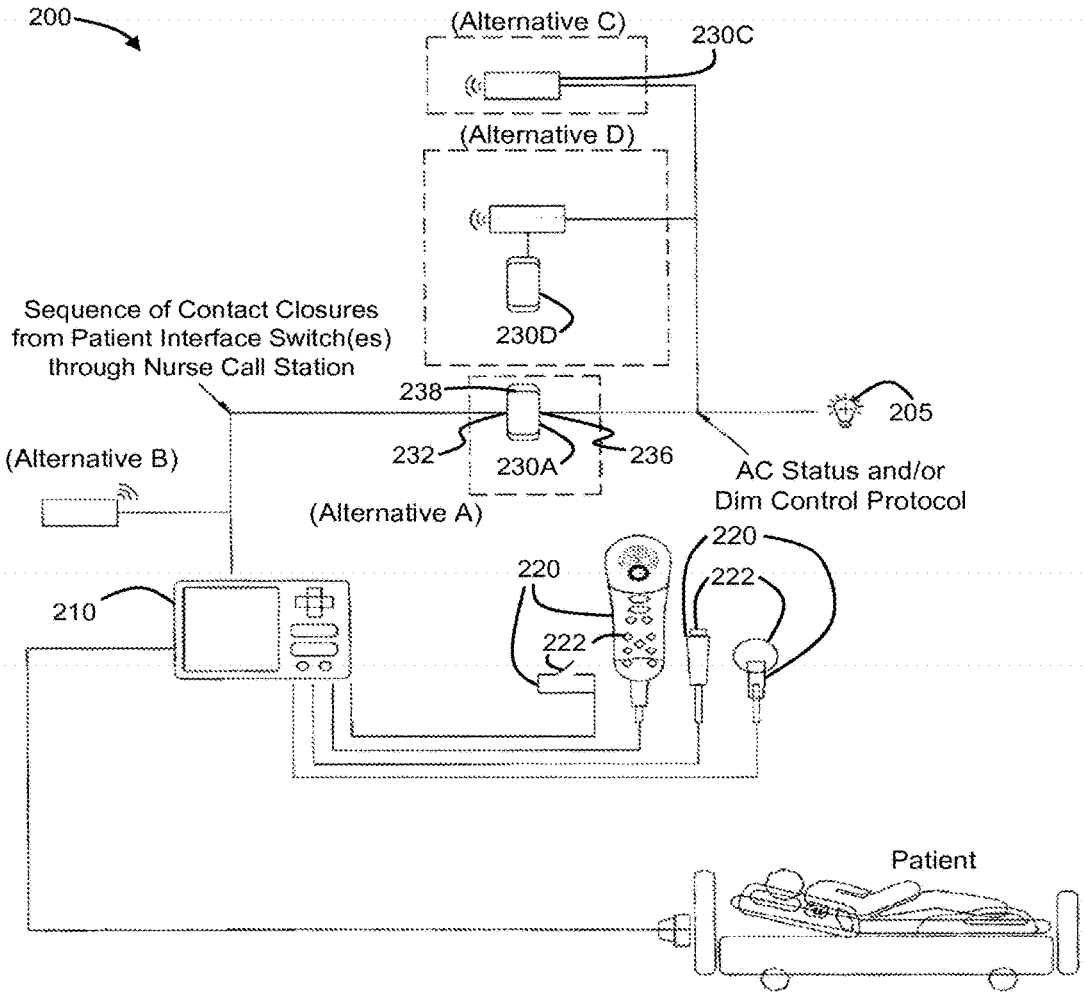
FIG. 5 is a diagram depicting a system according to another embodiment of the present disclosure.

With reference to FIG. 5, the present disclosure may be embodied as a load-control system 200 comprising a nurse call station 210 and a patient interface 220 in electronic communication with the nurse call station 210. The nurse call station 210 may be a centralized nurse call station 210 as a commonly used in the art to interface with a plurality of patient rooms in a hospital or other types of nurse call stations. The patient interface 220 may be a pillow speaker, a pendant, an interface integrated in a bed rail, or any other type of patient interface. The patient interface 220 includes a momentary switch 222 configured for low-voltage operation and operable by a user (e.g., a patient). For example, many pillow speakers currently include a momentary-contact switch for turning a light on or off. The patient interface may include more than one switch 222. The load-control system 200 further comprises a load 205, such as a lamp. The load 205 typically requires a high-voltage source for operation.

The system 200 further comprises a low-voltage controller 230 such as any of LVC embodiments described above. The LVC 230 of the system 200 includes a switch input 232 in electronic communication with the switch 222 of the patient interface 220. It should be noted that the switch input 232 may communicate with the switch 222 directly or indirectly. For example, the switch input 232 may communicate with the switch 222 by way of the nurse call station 210, receptacle plates such as a 37-pin interface commonly used in a hospital setting, and/or other components. The switch input 232 is configured to receive a low-voltage step signal from the switch 222 such as a signal generated when a user presses and/or releases the momentary switch 222 of the patient interface 220. It should be noted that the switch 222 and low-voltage signal may be configured in any appropriate manner. For example, the switch 222 may be a momentary close switch and the step signal may be a step from a base voltage (e.g., 0 VDC) to a signal voltage (e.g., 5 VDC). Other configurations of switches and/or signals will be apparent in light of the present disclosure.

The LVC 230 further comprises a line input 234 connected to a source of power at a line voltage (e.g., high voltage). The LVC further comprises a load output 236 in electronic communication with the load 205 for providing power to the load 205. A dimmer 238 of the LVC 230 is configured to set an intensity of the load 205 when a step signal is received at the switch input 232. The dimmer 238 may be configured to be a microcontroller 239, as previously described.

While dimmers of the present disclosure have been described using particular examples having microcontrollers, it should be noted that the disclosure includes dimmers designed with microcontrollers, discrete logic, integrated circuits, field-programmable gate arrays (FPGAs), application-specific integrated circuits (ASICs), or any other suitable technology or combinations of technologies.

Figure 6:
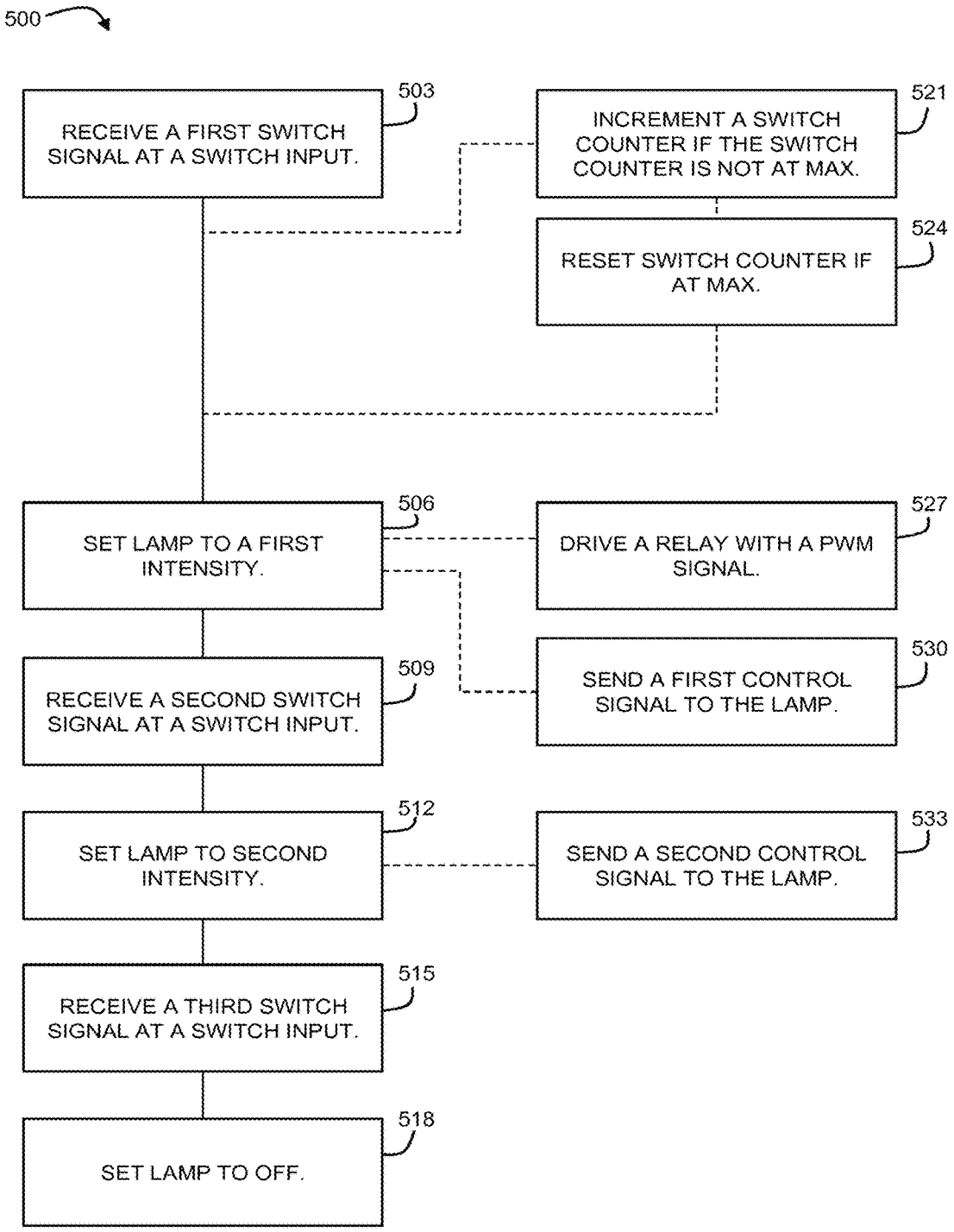
FIG. 6 is a flowchart depicting a method according to another embodiment of the present disclosure.

The present disclosure may be embodied as a method 500 for low-voltage control of a load (see, for example, FIG. 6). The method comprises the step of receiving 503 a first switch signal at a switch input of an LVC. The LVC may be in keeping with any LVC described above. The received 503 first switch signal is a low voltage step signal. The method 500 comprises setting 506 a lamp to a first intensity. The set 506 first intensity may be, for example, fully on, or any intensity level between off and fully on.

A second switch signal is received 509 at the switch input receiving a second switch signal at the switch input of the LVC, wherein the second switch signal is a low-voltage step signal. The method 500 comprises setting 512 the lamp to a second intensity which is different than the first intensity. The set 512 second intensity may be greater than the first intensity or less than the first intensity. The method 500 comprises the step of receiving 515 a third switch signal at the switch input of the LVC, wherein the third switch signal is a low-voltage step signal. The method 500 comprises setting 518 the lamp to off. Generally, the low-voltage step signals of the first, second, and third switch signals are similarly configured. For example, each of the switch signals is a falling edge. In some embodiments, other signals may be received at the switch input and ignored (for example, when the switch signal is a falling edge, a received signal of a rising edge may be ignored). The switch signal may be processed by the LVC to determine if it is a valid switch signal. For example, the switch signal may be debounced.

The method 500 may utilize an LVC having a microcontroller. In such a method 500, the LVC may have a microcontroller and the step of receiving 503 a first switch signal may comprise the sub-steps of incrementing 521 a switch counter if the switch counter is not at a maximum value; and resetting 524 the switch counter if the switch counter is at the maximum value. The step of setting 506 to a first intensity may further comprise the sub-step of energizing 527 a relay of the LVC. The relay may be energized 527 using a PWM signal.

In other embodiments, the LVC controls the load using a control signal at a control output. As such, the step of setting 506 the load to the first intensity may comprise the sub-step of sending 530 a first control signal to the load. Similarly, the step of setting 512 the lamp to the second intensity may comprise the sub-step of sending 533 a second control signal to the load. As described above, the control signal may be formatted according to a protocol such as, for example, 0-10V, ACN, ASCII, BACnet, DALI, DMX512, EnOcean, Konnex, LonWorks, MIDI, Modbus, RDM, SMPTE®, TCP/IP, an XML, Zigbee®, or Z Wave®. The protocol may be a wireless protocol.

Although the present disclosure has been described with respect to one or more particular embodiments, it will be understood that other embodiments of the present disclosure may be made without departing from the spirit and scope of the present disclosure. Hence, the present disclosure is deemed limited only by the appended claims and the reasonable interpretation thereof.

What is claimed is:

1. A method for low-voltage control of a lamp, comprising the steps of:

receiving a first switch signal at a switch input of a low-voltage controller (LVC), wherein the first switch signal is a low voltage step signal;

setting the lamp to a first intensity;

receiving a second switch signal at the switch input of the LVC, wherein the second switch signal is a low voltage step signal;

setting the lamp to a second intensity;

receiving a third switch signal at the switch input of the LVC, wherein the third switch signal is a low voltage step signal; and setting the lamp to off.

2. The method of claim 1, wherein the step of receiving a first switch signal at the switch input comprises the sub-steps of:

incrementing a switch counter if the switch counter is not at a maximum value;

resetting the switch counter if the switch counter is at the maximum value.

3. The method of claim 1, wherein:

the step of setting the lamp to the first intensity comprises the sub-step of energizing a relay with a pulse-width modulated (PWM) signal.

4. The method of claim 1, wherein the step of setting the lamp to a first intensity comprises the sub-step of sending a first control signal to the lamp.

5. The method of claim 4, wherein the first control signal is formatted according to a protocol.

6. The method of claim 5, wherein the protocol is 0-10V, ACN, ASCII, BACnet, DALI, DMX512, EnOcean, Konnex, LonWorks, MIDI, Modbus, RDM, SMPTE®, TCP/IP, an XML, Zigbee®, or Z-Wave®.

7. The method of claim 5, wherein the protocol is a wireless protocol.

* * * * *